US010190827B2

(12) United States Patent
Kasahara et al.

(10) Patent No.: US 10,190,827 B2
(45) Date of Patent: Jan. 29, 2019

(54) CONDENSER AND TURBINE EQUIPMENT

(71) Applicant: MITSUBISHI HITACHI POWER SYSTEMS, LTD., Kanagawa (JP)

(72) Inventors: Jiro Kasahara, Tokyo (JP); Keigo Nishida, Tokyo (JP); Taichi Nakamura, Tokyo (JP); Katsuhiro Hotta, Tokyo (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 188 days.

(21) Appl. No.: 15/108,116

(22) PCT Filed: Jan. 6, 2015

(86) PCT No.: PCT/JP2015/050180
§ 371 (c)(1),
(2) Date: Jun. 24, 2016

(87) PCT Pub. No.: WO2015/141239
PCT Pub. Date: Sep. 24, 2015

(65) Prior Publication Data

US 2016/0341480 A1 Nov. 24, 2016

(30) Foreign Application Priority Data

Mar. 19, 2014 (JP) ..... 2014-057167

(51) Int. Cl.
*F01K 5/00* (2006.01)
*F01K 9/00* (2006.01)
(Continued)

(52) U.S. Cl.
CPC ..... *F28B 1/02* (2013.01); *F01K 5/00* (2013.01); *F01K 9/003* (2013.01); *F28B 9/10* (2013.01); *F28D 7/1661* (2013.01)

(58) Field of Classification Search
CPC ..... F28B 1/00; F28B 1/02; F28B 1/04; F28B 9/10
See application file for complete search history.

(56) References Cited

U.S. PATENT DOCUMENTS 1,941,650 A * 1/1934 Baumann ..... F28B 1/02 165/114
2,956,784 A * 10/1960 Parkinson ..... F28B 9/10 165/112
(Continued)

FOREIGN PATENT DOCUMENTS

DE 580858 C * 7/1933 ..... F28B 9/10
GB 159128 A * 10/1921 ..... F28B 1/02
(Continued)

OTHER PUBLICATIONS

International Search Report dated Apr. 14, 2015 in International (PCT) Application No. PCT/JP2015/050180.
(Continued)

*Primary Examiner* — Laert Dounis
(74) *Attorney, Agent, or Firm* — Wenderoth, Lind & Ponack, L.L.P.

(57) ABSTRACT

A condenser includes a container into which steam is to flow, cooling pipes which are positioned inside the container and configured to cool the steam so as to form condensed water, at least one extraction pipe for extracting air included inside the container, at least one extraction hole which is defined in the extraction pipe and through which an interior of the at least one extraction pipe and an interior of the container communicate with each other, and a cylindrical cover which is configured with a gap spaced from the at least one extraction pipe and covers the at least one extraction hole so as to regulate an inflow of the condensed water into the at least one extraction hole. A plurality of the extraction holes
(Continued)

are formed around the extraction pipe, and the cylindrical cover is radially outside the at least one extraction pipe with the gap spaced therebetween.

2 Claims, 5 Drawing Sheets

(51) Int. Cl.

| | |
|---|---|
| ***F28B 1/02*** | (2006.01) |
| ***F28B 9/10*** | (2006.01) |
| ***F28D 7/16*** | (2006.01) |

(56) References Cited

U.S. PATENT DOCUMENTS

| | | | | |
|---|---|---|---|---|
| 3,327,774 | A | 6/1967 | Forster | |
| 3,834,133 | A * | 9/1974 | Bow | B01D 1/16 165/112 |
| 3,973,624 | A | 8/1976 | Bratthäll et al. | |
| 5,205,352 | A | 4/1993 | Takahashi et al. | |
| 6,041,852 | A * | 3/2000 | Sato | F28B 1/02 165/111 |
| 7,926,277 | B2 | 4/2011 | Harpster | |
| 2006/0112693 | A1 * | 6/2006 | Sundel | F01K 15/00 60/670 |

FOREIGN PATENT DOCUMENTS

| | | | | |
|---|---|---|---|---|
| GB | 331844 | A * | 7/1930 | F28B 1/02 |
| JP | 49-129004 | | 12/1974 | |
| JP | 54-111002 | | 8/1979 | |
| JP | 58184488 | A * | 10/1983 | F28B 9/10 |
| JP | 60232489 | A * | 11/1985 | F28B 1/02 |
| JP | 4-244589 | | 9/1992 | |
| JP | 2004-169984 | | 6/2004 | |

OTHER PUBLICATIONS

Written Opinion of the International Searching Authority dated Apr. 14, 2015 in International (PCT) Application No. PCT/JP2015/050180, with English translation.

* cited by examiner

CONDENSER AND TURBINE EQUIPMENT

FIELD

The present invention relates to a condenser provided with an extraction pipe for extracting a noncondensable gas and turbine equipment.

BACKGROUND

Conventionally, a condenser which condenses steam containing a noncondensable gas and exhausts the noncondensable gas is known (for example, see Japanese Patent Application Publication No. 4-244589). The condenser is formed with an exhaust port and the noncondensable gas such as air is exhausted to an air cooling unit through the exhaust port. The air cooling unit is provided with an air cooling unit pipe group, and the noncondensable gas exhausted to the air cooling unit is exhausted to an outside while non-condensed steam is condensed by the air cooling unit pipe group.

TECHNICAL PROBLEM

As in Japanese Patent Application Publication No. 4-244589, since pressure of an interior of the condenser is lower than that of an outside thereof, the noncondensable gas such as air leaks into the condenser from the outside. When the noncondensable gas is present inside the condenser, condensation of a condensable gas such as the steam to be condensed inside the condenser is inhibited. For this reason, it is necessary to discharge the noncondensable gas to the outside of the condenser.

Here, an extraction pipe for extracting the noncondensable gas is provided inside the condenser in some cases. The extraction pipe is formed with extraction holes through which the interior of the condenser and the interior of the extraction pipe communicate with each other. Each of the extraction holes is formed with an aperture ratio adjusted depending on a pressure distribution in the longitudinal direction of the extraction pipe (the axial direction of the pipe).

However, there is a possibility that a condensate (condensed water) condensed inside the condenser falls in the extraction pipe to clog the extraction holes. When the extraction holes are clogged by the condensate, the adjustment of the extraction holes depending on the pressure distribution in the longitudinal direction of the extraction pipe becomes useless, and thus there is a possibility that the efficiency of the extraction of the noncondensable gas through the extraction pipe is decreased.

SUMMARY

In this regard, an object of the present invention is to provide a condenser and turbine equipment in which a performance of extraction of a noncondensable gas through an extraction air flow path can be maintained.

SOLUTION TO PROBLEM

According to the present invention, there is provided a condenser comprising: a container into which a condensable gas flows; cooling pipes which are provided inside the container and cool the condensable gas to form a condensate; an extraction air flow path for extracting a noncondensable gas included inside the container; at least one extraction hole which is formed in the extraction air flow path and through which an interior of the extraction air flow path and an interior of the container communicate with each other; and at least one cover which is provided with a predetermined gap spaced from the extraction air flow path and covers the at least one extraction hole to regulate an inflow of the condensate into the at least one extraction hole.

With this configuration, although the cooling pipe generates the condensate, the cover can regulate the inflow of the condensate into the extraction holes, and thus it can be suppressed that the condensate clogs the extraction holes. For this reason, the noncondensable gas can be appropriately extracted through the extraction holes depending on a pressure distribution in the longitudinal direction of the extraction air flow path, and thus the performance of the extraction of the noncondensable gas through the extraction pipe can be maintained.

Preferably, the extraction air flow path is composed of at least one extraction pipe, a plurality of the extraction holes are formed around the extraction pipe, and the cover is a cylindrical cover which is provided radially outside the extraction pipe with the predetermined gap spaced therebetween.

With this configuration, in a case where the extraction air flow path is the extraction pipe, the inflow of the condensate into the extraction holes can be suppressed with the simple configuration in such a manner that the outside of the extraction pipe is covered by the cylindrical cover.

Preferably, an axial direction of the cylindrical cover is set to be a horizontal direction, an opening portion is formed in a lower region of the cylindrical cover in a vertical direction, a line coupling a center of the cylindrical cover and one end portion of the opening portion in a circumferential direction of the cylindrical cover is set to a first coupling line, a line coupling the center of the cylindrical cover and the other end portion of the opening portion in the circumferential direction of the cylindrical cover is set to a second coupling line, and when an angle formed by the first coupling line and the second coupling line is set to an opening angle $\theta$, the opening angle $\theta$ is in a range of $45° < \theta < 120°$.

With this configuration, since the opening angle of the opening portion can be set to an appropriate angle, the inflow of the condensate into the extraction pipe can be suppressed while the noncondensable gas is allowed to flow into the extraction pipe.

Preferably, the gap between the extraction pipe and the cylindrical cover in a radial direction is formed such that an area of a flow path between the extraction pipe and the cylindrical cover is larger than opening areas of the plurality of the extraction holes formed in the extraction pipe.

With this configuration, since it is possible to increase the flow rate of the noncondensable gas flowing between the extraction pipe and the cylindrical cover with respect to the extraction air amount of the noncondensable gas absorbed into the extraction pipe through the extraction holes, the pressure loss between the extraction pipe and the cylindrical cover can be reduced.

Preferably, the extraction air flow path is composed of an extraction box, the at least one extraction hole is formed in a side surface of the extraction box which is a vertical surface, and the cover includes an upper cover which protrudes from the side surface of the extraction box above the at least one extraction hole and covers the at least one extraction hole with a predetermined gap spaced from the side surface of the extraction box.

With this configuration, in a case where the extraction air flow path is the extraction box, the extraction holes formed in the side surface of the extraction box is covered by the upper cover so that the inflow of the condensate into the extraction holes can be suppressed.

Preferably, the cover further includes a lower cover which protrudes from the side surface of the extraction box below the at least one extraction hole and covers the upper cover with a predetermined gap spaced from the upper cover.

With this configuration, the noncondensable gas flows between the lower cover and the upper cover, then flows between the upper cover and the side surface of the extraction box, and then flows into the extraction box through the extraction holes. Thus, the inflow of the condensate to the extraction hole can be more preferably suppressed by additionally providing the lower cover.

Preferably, the lower cover is provided with a drain hole for discharging the condensate.

With this configuration, the condensate accumulated in the lower cover can be discharged through the drain hole.

According to the present invention, there is provided turbine equipment comprising: a heater which heats a condensate to generate a condensable gas; a turbine which is rotated by the condensable gas generated in the heater; and the condenser described above which condenses the condensable gas discharged from the turbine.

With this configuration, since it is possible to preferably extract the noncondensable gas inside the condenser, the condensation of the condensable gas can be efficiently performed, and thus, a low-pressure state on the back pressure side of the turbine can be maintained. Accordingly, the work efficiency of the turbine can be preferably maintained.

DESCRIPTION OF EMBODIMENTS

Hereinafter, embodiments according to the present invention will be described in detail based on the drawings. Incidentally, the invention is not limited to the embodiments. In addition, components in the following embodiments include a component, which can be easily replaced by a person skilled in the art, or the substantially same component. Further, the components described below may be combined appropriately, and in the case of several embodiments, the embodiments may be combined with each other.

First Embodiment

Figure 1:
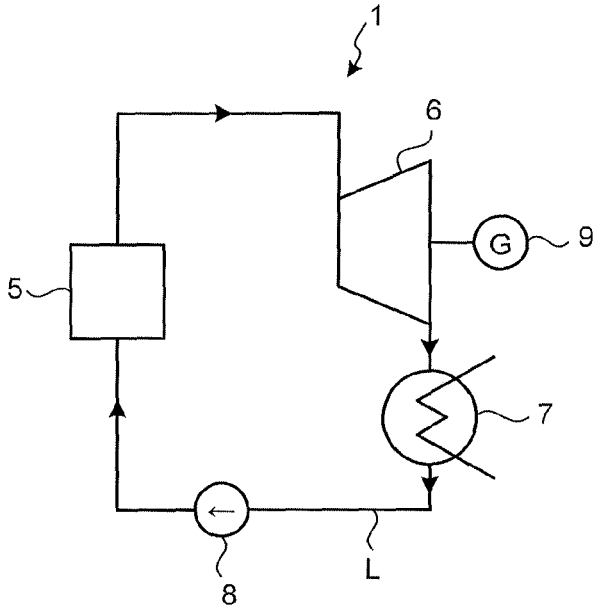
FIG. 1 is a diagram schematically illustrating turbine equipment according to a first embodiment.
Figure 2:
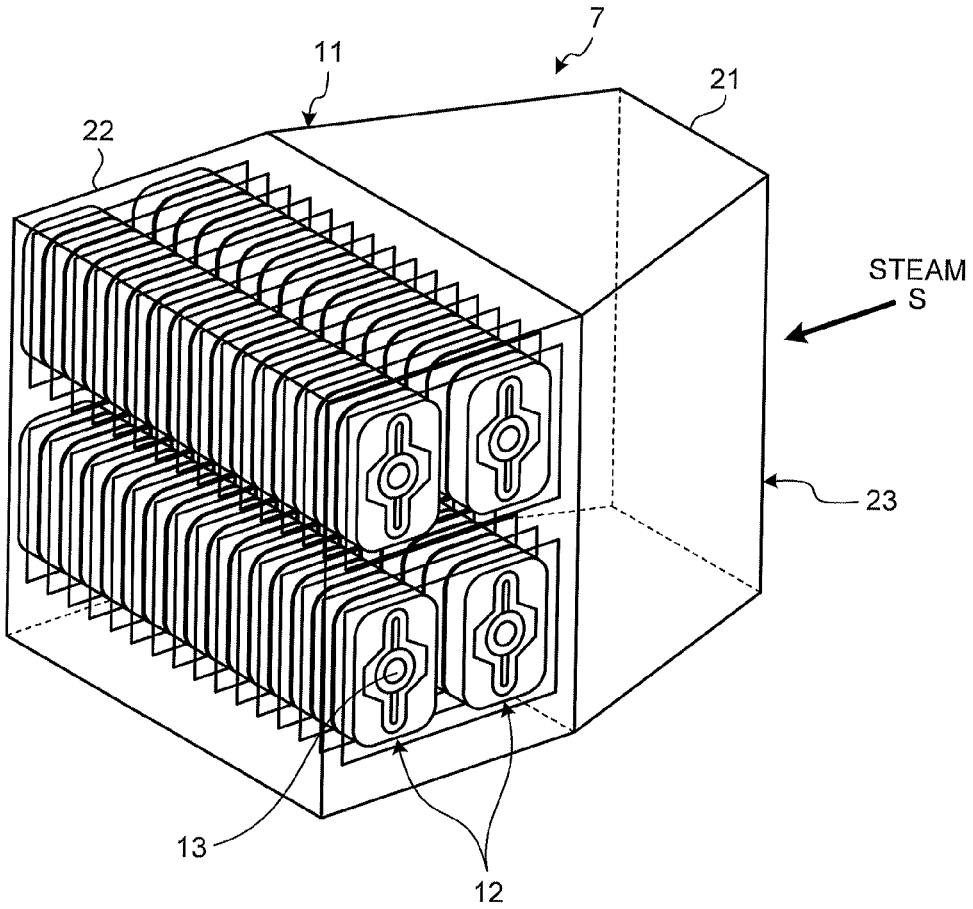
FIG. 2 is a perspective view schematically illustrating a condenser according to the first embodiment.
Figure 3:
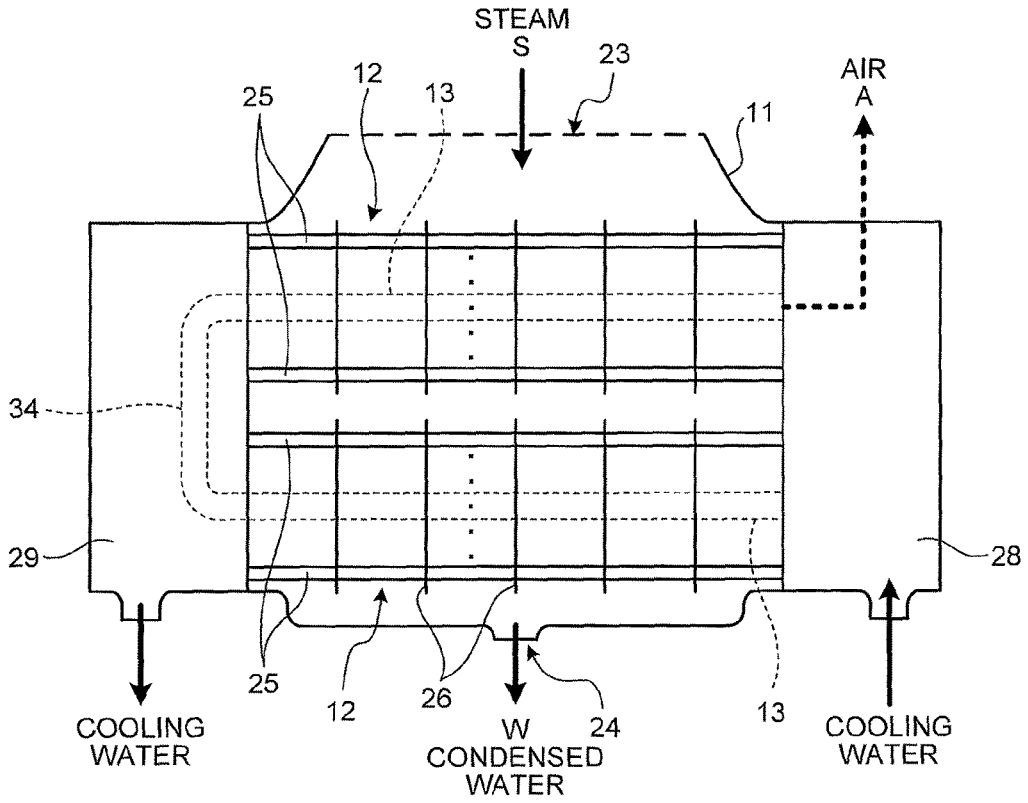
FIG. 3 is a cross-sectional view schematically illustrating the condenser according to the first embodiment.
Figure 4:
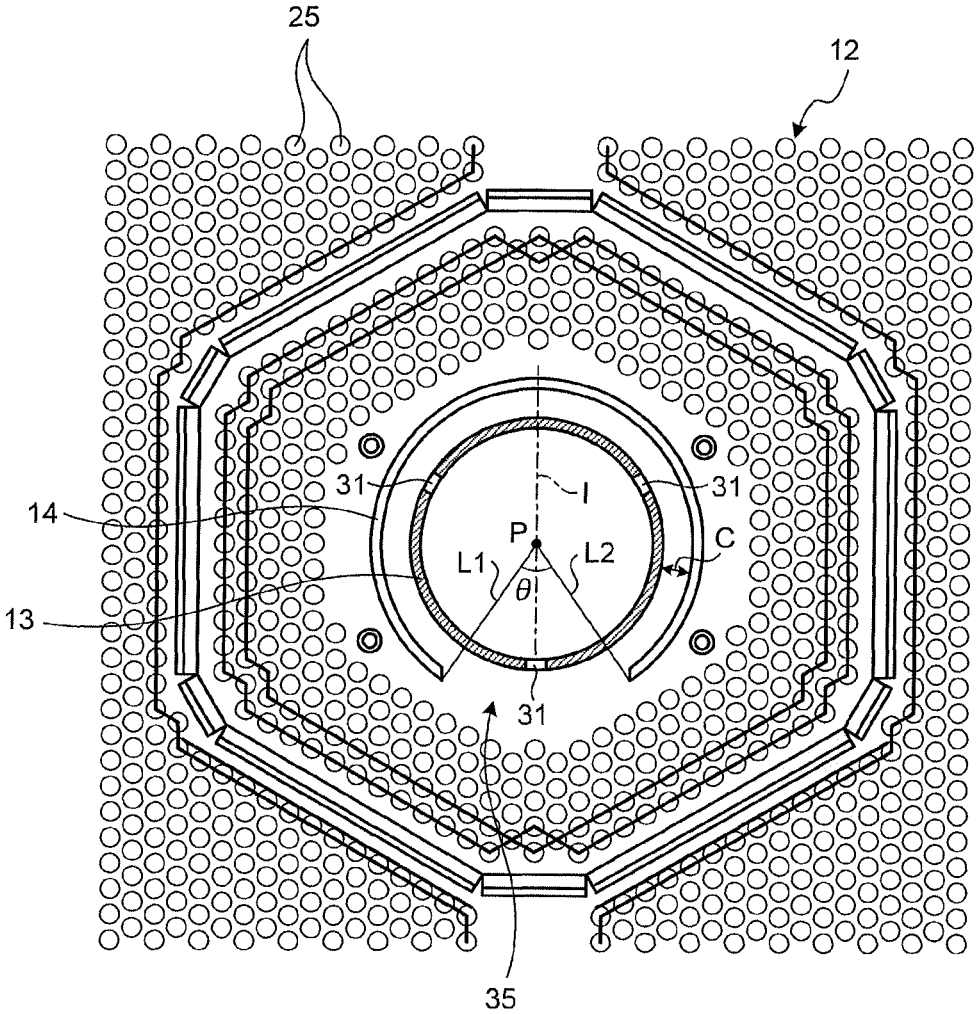
FIG. 4 is a cross-sectional view illustrating the vicinity of an extraction pipe of the first embodiment when taken along the surface orthogonal to a longitudinal direction.

FIG. 1 is a diagram schematically illustrating turbine equipment according to a first embodiment. FIG. 2 is a perspective view schematically illustrating a condenser according to the first embodiment. FIG. 3 is a cross-sectional view schematically illustrating the condenser according to the first embodiment. FIG. 4 is a cross-sectional view illustrating the vicinity of an extraction pipe of the first embodiment when taken along the surface orthogonal to a longitudinal direction.

Turbine equipment 1 of the first embodiment is steam turbine equipment which generates steam S as a condensable gas and rotates a turbine 6 using the generated steam S. The turbine equipment 1 is provided with a condenser 7 in order to lower the back pressure of the turbine 6. First, the turbine equipment 1 will be described with reference to FIG. 1.

The turbine equipment 1 includes a heater 5, the turbine 6, the condenser 7, a circulating pump 8, and a generator 9, which are connected by a circulating line L.

The heater 5 is, for example, a boiler, and generates the steam S by heating water (condensed water) W. The condensed water, which is condensed in the condenser 7 described later, flows into the heater 5. In addition, the steam S generated in the heater 5 is supplied to the turbine 6 through the circulating line L.

The turbine 6 is rotated by the steam S supplied from the heater 5. The turbine 6 is connected to the generator 9 and rotational power of the turbine 6 drives the generator 9 so that the generator 9 generates electrical power. The steam S discharged from the turbine 6 flows into the condenser 7 through the circulating line L.

The condenser 7 condenses the steam S flowed therein from the turbine 6 to form the condensed water W so that the back pressure of the turbine 6 is lowered. Incidentally, the condenser 7 will be described later in detail. Then, the condensed water W generated in the condenser 7 is supplied to the circulating pump 8 through the circulating line L. The circulating pump 8 supplies the condensed water W supplied from the condenser 7 toward the heater 5.

Accordingly, in the turbine equipment 1, the heater 5 heats the condensed water W to generate the steam S, and the turbine 6 is rotated by the generated steam S so that the generator 9 generates the electrical power. In addition, in the turbine equipment 1, the condenser 7 returns the steam S used in the turbine 6 into the condensed water W and the circulating pump 8 supplies the condensed water W to the heater 5.

Next, with reference to FIGS. 2 to 4, the condenser 7 will be described. The condenser 7 includes a container 11 into which the steam S flows, cooling pipe groups 12 provided inside the container 11, an extraction pipe 13 provided in the center of each cooling pipe group 12, and a cylindrical cover 14 which covers the extraction pipe 13.

As illustrated in FIG. 2, the container 11 is formed in a hollow-box shape, and includes a steam inlet portion 21 into which the steam S flows and a main body 22 which contains the cooling pipe groups 12. The interior of the steam inlet portion 21 and the interior of the main body 22 communicate with each other. The steam inlet portion 21 is provided with an inlet port 23 for the steam S in the end portion thereof, and the inlet port 23 is connected with one end of the circulating line L connecting the turbine 6 and the condenser 7. The main body 22 accumulates the condensed water W, which is generated by condensing the steam S which flows in from the steam inlet portion 21, in the lower portion thereof. Incidentally, the main body 22 is provided with an outlet port (see FIG. 3) 24 for discharging the condensed water W, and the outlet port 24 is connected to one end of the circulating line L connecting the condenser 7 and the circulating pump 8.

The four cooling pipe groups 12 are arranged in a vertical direction and a horizontal direction. The cooling pipe groups 12 are configured to be disposed in parallel such that the longitudinal direction of a plurality of cooling pipes 25 (the axial direction of the pipe) is set to be the horizontal direction. At this time, the cooling pipe groups 12 are disposed such that the longitudinal direction of the cooling pipe 25 and the flowing direction of the steam S are perpendicular to each other.

In addition, as illustrated in FIG. 3, the both end portions of the cooling pipe group 12 are supported by side walls of the container 11, and the intermediate portion thereof is supported by a plurality of tube support plates 26. In the plurality of the cooling pipes 25 configuring the cooling pipe group 12, one end portion thereof communicates with and is connected to an inlet water room 28 provided on the outside of the side wall of the container 11, and the other end portion thereof communicates with and is connected to an outlet water room 29 provided on the outside of the side wall of the container 11. Cooling water is supplied to the inlet water room 28 while the cooling water is discharged from the outlet water room 29.

As illustrated in FIGS. 3 and 4, the extraction pipe 13 is provided in the center of the interior of each cooling pipe group 12, and is disposed in parallel with the plurality of the cooling pipes 25. For this reason, the longitudinal direction of the extraction pipe 13 is set to be the horizontal direction. The extraction pipe 13 is a pipe for extracting air A as a noncondensable gas included inside the condenser 7. One end of the extraction pipe 13 is connected to a suction device (not illustrated), and the suction device sucks the interior of the extraction pipe 13 to extract the air A inside the condenser 7. Incidentally, the extraction pipe 13 is provided in each of the plurality of the cooling pipe groups 12, and a plurality of the extraction pipes 13 are connected with each other by connection pipes 34.

The extraction pipe 13 is formed to be a cylindrical pipe in which the air A flows, and a plurality of extraction holes 31 are formed around the extraction pipe. The plurality of the extraction holes 31 are formed with an adjustment performed depending on the pressure distribution of the interior of the condenser 7 in the longitudinal direction of the extraction pipe 13. That is, the air A can flow into the extraction pipe 13 more easily through the extraction hole 31, which is formed in a region in which pressure of the interior of the condenser 7 is high in the longitudinal direction of the extraction pipe 13, than through the extraction hole 31 which is formed in a region in which the pressure is low. For this reason, the extraction hole 31, which is formed in the region in which the pressure of the interior of the condenser 7 is high, is formed to be smaller than the extraction hole 31 which is formed in the region in which the pressure is low.

As illustrated in FIG. 4, the cylindrical cover 24 is provided radially outside the extraction pipe 13 with a predetermined gap C spaced therebetween. Since the cylindrical cover 14 is provided coaxially with the extraction pipe 13, the cylindrical cover is disposed in the horizontal direction similarly with the extraction pipe 13. The cylindrical cover 14 may be installed in the extraction pipe 13 through a stay (not illustrated), may be installed in a supporting rod (so-called tie rod; not illustrated) provided inside the condenser 7, and is not particularly limited thereto.

In addition, the cylindrical cover 14 is formed with an opening portion 35 in the lower region thereof in the vertical direction. The opening portion 35 is formed to broaden to both sides in a circumferential direction with a center line I, which extends through a center P of the cylindrical cover 14 in the vertical direction. In addition, the opening portion 35 is formed to extend along the longitudinal direction of the cylindrical cover 14.

Here, a line coupling the center P of the cylindrical cover 14 and one end portion of the opening portion 35 in the circumferential direction of the cylindrical cover 14 in a plane perpendicular to the cylindrical cover 14 is set to a first coupling line L1. In addition, a line coupling the center P of the cylindrical cover 14 and the other end portion of the opening portion 35 in the circumferential direction of the cylindrical cover 14 in a plane perpendicular to the cylindrical cover 14 is set to a second coupling line L2. When the angle formed by the first coupling line L1 and the second coupling line L2 is set to an opening angle θ, the opening angle θis set to be in a range of $45° \leq \theta \leq 120°$.

In addition, the gap C between the extraction pipe 13 and the cylindrical cover 14 in a radial direction is formed such that a cross-sectional area of the flow path in a plane perpendicular to the flow path, which is formed between the extraction pipe 13 and the cylindrical cover 14 and in which the air A flows, is larger than a total opening area of the plurality of the extraction holes 31 formed in the extraction pipe 13.

In the condenser 7 having the above configuration, when the steam S flows into the container 11 from the steam inlet portion 21 of the container 11, the steam S is condensed by the cooling pipe groups 12 to be the condensed water W. At this time, the cooling water supplied from the inlet water room 28 flows in the plurality of the cooling pipes 25 configuring the cooling pipe group 12. Then, the cooling water having flown in the cooling pipes 25 flows into the outlet water room 29. That is, the steam S is condensed to be the condensed water W through heat exchange with the cooling water flowing inside the cooling pipe.

The condensed water W condensed by the cooling pipe groups 12 drips downward in the vertical direction. At this time, the condensed water W dripping above the extraction pipe 13 avoids the extraction pipe 13 by the cylindrical cover 14 to be guided to the lower portion of the container 11. For this reason, the condensed water W which is condensed is stored in the lower portion of the container 11. Then, the condensed water W stored in the lower portion of the container 11 effuses through the outlet port 24 toward the circulating pump 8.

As described above, according to the first embodiment, although the condensed water W is generated by the cooling pipes 25, the cylindrical cover 14 can regulate the inflow of the condensed water W into the extraction holes 31, and thus clogging of the extraction holes 31 with the condensed water W can be suppressed. For this reason, the air A can be appropriately extracted through the extraction holes 31 depending on the pressure distribution in the longitudinal direction of the extraction pipe 13, and thus the performance of the extraction of the air A through the extraction pipes 13 can be maintained.

In addition, according to the first embodiment, the inflow of the condensed water W into the extraction holes 31 can be suppressed with the simple configuration by covering the outside of the extraction pipe 13 with the cylindrical cover 14.

In addition, according to the first embodiment, since the opening angle θ of the opening portion 35 can be set to an appropriate angle, the inflow of the condensed water W into the extraction pipes 13 can be suppressed while the air A is allowed to flow into the extraction pipes 13.

In addition, according to the first embodiment, since it is possible to increase the flow rate of the air A flowing through the gap C between the extraction pipe 13 and the cylindrical cover 14 with respect to the extraction air amount of the air A absorbed into the extraction pipe 13 through the extraction holes 31, the pressure loss in the flow path between the extraction pipe 13 and the cylindrical cover 14 can be reduced.

In addition, according to the first embodiment, since it is possible to preferably extraction the air A inside the condenser 7, the condensation of the steam S can be efficiently performed, and thus, a low-pressure state on the back pressure side of the turbine 6 can be preferably maintained. Accordingly, the work efficiency of the turbine 6 can be preferably maintained.

Second Embodiment

Figure 5:
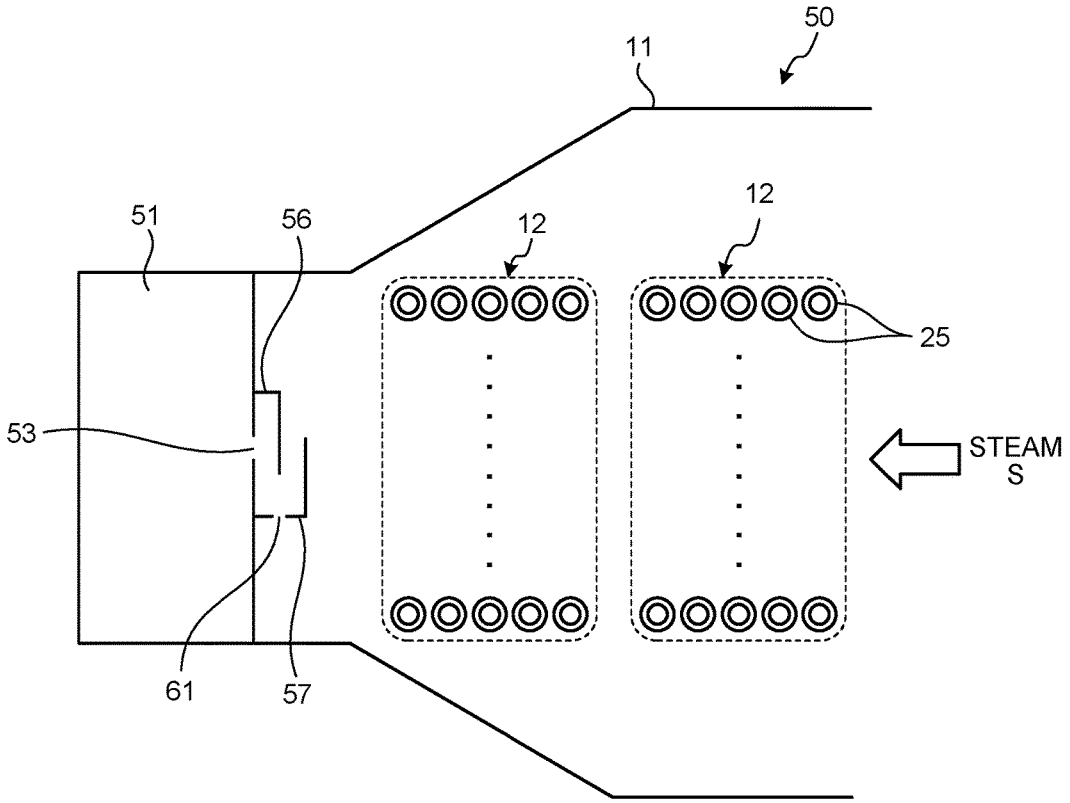
FIG. 5 is a cross-sectional view illustrating the vicinity of an extraction box of a second embodiment when taken along the surface orthogonal to the longitudinal direction.

Next, with reference to FIG. 5, a condenser 50 according to a second embodiment will be described. FIG. 5 is a cross-sectional view illustrating the vicinity of a extraction box of the second embodiment when taken along the surface orthogonal to the longitudinal direction. Incidentally, in the second embodiment, in order to avoid redundant description, parts which differ from the description of the first embodiment will be described and parts which are same as the description of the first embodiment will be described with the same reference numerals given thereto. Although the air A is extracted using the extraction pipes 13 in the first embodiment, the air A is extracted using an extraction box 51 in the second embodiment.

Specifically, as illustrated in FIG. 5, the condenser 50 of the second embodiment includes the container 11 into which the steam S flows, the cooling pipe groups 12 provided inside the container 11, the extraction box 51 attached to the container 11, an upper cover 56 and a lower cover 57 provided in a side wall of the container 11. Incidentally, the container 11 and the cooling pipe groups 12 are substantially similar to those of the first embodiment, and thus the description thereof is not repeated.

The extraction box 51 is formed in a hollow-box shape, and is provided on the outside of the side wall of the container 11. For this reason, the side wall of the container 11 is formed to be the side surface of the extraction box 51, and the side surface of the extraction box 51 is formed to be a vertical surface. The longitudinal direction of the extraction box 51 is set to be the horizontal direction, one end of the extraction box is connected to the suction device (not illustrated), and the suction device sucks the interior of the extraction box 51 to extract the air A inside the condenser 7.

A plurality of extraction holes 53 are formed in the side surface of the extraction box 51. The plurality of extraction holes 53 are formed to be arranged with a predetermined gap spaced therebetween in the horizontal direction. As with the plurality of the extraction holes 31 of the first embodiment, the plurality of extraction holes 53 are formed with an adjustment performed depending on the pressure distribution of the interior of the condenser 7 in the longitudinal direction of the extraction box 51.

The upper cover 56 is formed such that the upper cover protrudes from the side surface of the extraction box 51 above the extraction holes 53 toward the interior of the condenser 7 and extends downward in the vertical direction with a predetermined gap spaced from the side surface of the extraction box 51. Then, the upper cover 56 covers the plurality of the extraction holes 53 formed in the side surface of the extraction box 51.

The lower cover 57 is formed such that the lower cover protrudes from the side surface of the extraction box 51 below the extraction holes 53 toward the interior of the condenser 7 and extends upward in the vertical direction with a predetermined gap spaced from the upper cover 56. Then, the lower cover 57 covers the upper cover 56. That is, the upper cover 56 and the lower cover 57 are formed to overlap with each other in the horizontal direction.

At this time, the gap between the side surface of the extraction box 51 and the upper cover 56 and the gap between the upper cover 56 and the lower cover 57 are formed, as with that in the first embodiment, such that the cross-sectional area of the flow path in a plane perpendicular to the flow path, which is formed in each gap and in which the air A flows, is larger than the total opening area of the plurality of the extraction holes 53 formed in the side surface of the extraction box 51.

In addition, the lower cover 57 is formed with a drain hole 61 for discharging the condensed water W stored in the lower cover 57. The condensed water W discharged through the drain hole 61 is stored in the lower portion of the container 11.

As described above, according to the second embodiment, the plurality of the extraction holes 53 formed in the side surface of the extraction box 51 are covered with the upper cover 56 so that the inflow of the condensed water W into the extraction holes 53 can be suppressed.

In addition, according to the second embodiment, since the upper cover 56 is covered with the lower cover 57, the air A flows between the lower cover 57 and the upper cover 56, then flows between the upper cover 56 and the side surface of the extraction box 51, and then flows into the extraction box 51 through the extraction holes 53. Thus, the inflow of the condensed water W into the extraction holes 53 can be more preferably suppressed by additionally providing the lower cover 57.

In addition, according to the second embodiment, the drain hole 61 is formed in the lower cover 57 so that the condensed water W stored in the lower cover 57 can be discharged through the drain hole 61.

Incidentally, although the upper cover 56 and the lower cover 57 are provided in the second embodiment, the lower cover 57 may be not provided as long as at least the upper cover 56 is provided.

REFERENCE SIGNS LIST

1 TURBINE EQUIPMENT
5 HEATER
6 TURBINE
7 CONDENSER
8 CIRCULATING PUMP
9 GENERATOR
11 CONTAINER
12 COOLING PIPE GROUP
13 EXTRACTION PIPE
14 CYLINDRICAL COVER
21 STEAM INLET PORTION
22 MAIN BODY
23 INLET PORT
24 OUTLET PORT
25 COOLING PIPE
26 TUBE SUPPORT PLATE
28 INLET WATER ROOM
29 OUTLET WATER ROOM
31 EXTRACTION HOLE
34 CONNECTION PIPE
35 OPENING PORTION
50 CONDENSER
51 EXTRACTION BOX
53 EXTRACTION HOLE
56 UPPER COVER
57 LOWER COVER

61 DRAIN HOLE
S STEAM
W CONDENSED WATER
A AIR
L CIRCULATING LINE
C GAP
I CENTER LINE
L1 FIRST COUPLING LINE
L2 SECOND COUPLING LINE

The invention claimed is:

1. A condenser comprising:

a container into which a condensable gas is to flow;

cooling pipes which are positioned inside the container and configured to cool the condensable gas so as to form a condensate;

an extraction air flow path for extracting a noncondensable gas included inside the container;

at least one extraction hole which is defined in the extraction air flow path and through which an interior of the extraction air flow path and an interior of the container communicate with each other; and at least one cover which is configured with a gap spaced from the extraction air flow path and covers the at least one extraction hole so as to regulate an inflow of the condensate into the at least one extraction hole, wherein:

the extraction air flow path is composed of an extraction box, the at least one extraction hole is defined in a side surface of the extraction box which is a vertical surface, the at least one cover includes an upper cover which protrudes from the side surface of the extraction box above the at least one extraction hole and covers the at least one extraction hole with a gap spaced from the side surface of the extraction box, and a lower cover which protrudes from the side surface of the extraction box below the at least one extraction hole and covers the upper cover with a gap spaced from the upper cover such that the upper cover ends before the lower cover, the lower cover extends beyond an end of the upper cover, and the lower cover includes a drain hole for discharging the condensate.

2. Turbine equipment comprising:

a heater configured to heat a condensate to generate a condensable gas;

a turbine configured to be rotated by the condensable gas generated in the heater; and the condenser according to claim 1 which is configured to condense the condensable gas discharged from the turbine.

* * * * *